US006684967B2

(12) United States Patent
Mensa-Wilmot et al.

(10) Patent No.: US 6,684,967 B2
(45) **Date of Patent: *Feb. 3, 2004**

(54) SIDE CUTTING GAGE PAD IMPROVING STABILIZATION AND BOREHOLE INTEGRITY

(75) Inventors: Graham Mensa-Wilmot, Houston, TX (US); Peter K. Chan, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/897,580

(22) Filed: Jul. 2, 2001

(65) Prior Publication Data

US 2002/0079139 A1 Jun. 27, 2002

Related U.S. Application Data

(63) Continuation-in-part of application No. 09/368,833, filed on Aug. 5, 1999, now Pat. No. 6,253,863.

(51) Int. Cl.[7] ..... E21B 12/04
(52) U.S. Cl. ..... 175/408; 175/431
(58) Field of Search ..... 175/385, 399, 175/391, 406, 408

(56) References Cited

U.S. PATENT DOCUMENTS

| | | | | |
|---|---|---|---|---|
| 5,740,873 A | | 4/1998 | Tibbitts | 175/393 |
| 5,967,247 A | | 10/1999 | Pessier | 175/408 |
| 6,123,160 A | * | 9/2000 | Tibbitts | 175/385 |
| 6,206,117 B1 | * | 3/2001 | Tibbitts et al. | 175/399 |
| 6,253,863 B1 | * | 7/2001 | Mensa-Wilmot et al. | 175/408 |
| 6,349,780 B1 | * | 2/2002 | Beuershausen | 175/408 |

FOREIGN PATENT DOCUMENTS

| | | | |
|---|---|---|---|
| EP | 0 127 077 | 5/1983 | E21B/10/46 |
| EP | 0 164 297 | 12/1985 | E21B/10/46 |
| EP | 0 710 765 | 5/1996 | E21B/10/54 |
| EP | 0 962 620 | 12/1999 | E21B/10/26 |
| GB | 2 301 852 | 12/1996 | E21B/10/46 |
| GB | 2 328 964 | 3/1999 | E21B/10/46 |
| GB | 2 352 748 | 2/2001 | E21B/10/46 |
| GB | 2 359 572 | 8/2001 | E21B/10/42 |

OTHER PUBLICATIONS

UK Search Report dated Nov. 30, 2000 (3 p.).
UK Search Report dated Oct. 2, 2002 (1 p.).

* cited by examiner

*Primary Examiner*—William Neuder
(74) *Attorney, Agent, or Firm*—Conley Rose, P.C.

(57) ABSTRACT

A drill bit including improved gage pads is particularly adapted for side cutting a borehole wall. In a preferred embodiment, the drill bit gage pads alternate between an active gage pad with a cutting surface portion and a non-active gage pad with a wear-resistant surface. Gage pad cutting elements placed on a first active gage pad cooperate with gage pad cutting elements placed on other active gage pads. What results is a contiguous series of overlapping cutting elements suitable to cut the borehole wall. Non-active gage pads are preferably placed between the active cutting gage pads. These non-active gage pads have a wear-resistant surface (such as steel or diamond insert) that extends to the gage diameter. These non-active gage pads help to maintain borehole size and prevent undue torque being placed on the drill bit.

28 Claims, 13 Drawing Sheets

SIDE CUTTING GAGE PAD IMPROVING STABILIZATION AND BOREHOLE INTEGRITY

CROSS-REFERENCE TO RELATED APPLICATIONS

This is a continuation-in-part application of U.S. patent application Ser. No. 09/368,833, filed Aug. 5, 1999 and entitled "Side Cutting Gage Pad Improving Stabilization and Borehole Integrity".

STATEMENT REGARDING FEDERALLY SPONSORED RESEARCH OR DEVELOPMENT

Not Applicable.

BACKGROUND OF THE INVENTION

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downward, causing the bit to cut through the formation material by either abrasion, fracturing, or shearing action, or through a combination of all cutting methods. While the bit rotates, drilling fluid is pumped through the drill string and directed out of the drill bit through nozzles that are positioned in the bit face. The drilling fluid cools the bit and flushes cuttings away from the cutting structure and face of the bit. The drilling fluid and cuttings are forced from the bottom of the borehole to the surface through the annulus that is formed between the drill string and the borehole.

Many different types of drill bits with different rock removal mechanisms have been developed and found useful in drilling such boreholes. Such bits include diamond impregnated bits, milled tooth bits, tungsten carbide insert ("TCI") bits, polycrystalline diamond compacts ("PDC") bits, and natural diamond bits. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability. In soft to hard formations, fixed cutter bits having a PDC cutting structure have been employed with varying degrees of success.

The cost of drilling a borehole is proportional to the length of time it takes to drill the borehole to the desired depth and location. The drilling time, in turn, is greatly affected by the number of times the drill bit must be changed in order to reach the targeted formation. This is because each time the bit is changed, the entire drill string, which may be miles long, must be retrieved from the borehole section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, it is always desirable to employ drill bits that will drill faster and longer and that are usable over a wider range of differing formation hardnesses.

The length of time that a drill bit is kept in the hole before the drill string must be tripped and the bit changed depends upon a variety of factors. These factors include the bit's rate of penetration ("ROP"), its durability or ability to maintain a high or acceptable ROP, and its ability to achieve the objectives outlined by the drilling program (especially in directional applications).

In recent years, the PDC bit has become an industry standard for cutting formations of soft and medium hardnesses. The cutter elements used in such bits are formed of extremely hard materials, which sometimes include a layer of thermally stable polycrystalline ("TSP") material or polycrystalline diamond compacts ("PDC"). In the typical PDC bit, each cutter element or assembly comprises an elongate and generally cylindrical support member which is received and secured in a pocket formed in the surface of the bit body. A disk or tablet-shaped, hard cutting layer of polycrystalline diamond is bonded to the exposed end of the support member, which is typically formed of tungsten carbide. Although such cutter elements historically were round in cross section and included a disk shaped PDC layer forming the cutting face of the element, improvements in manufacturing techniques have made it possible to provide cutter elements having PDC layers formed in other shapes as well. A PDC bit may also include on the side of the drill bit gage pads that, among other things, result in a reduction of the amount of vibration of the drill bit through maintenance of gage diameter. A "stable" PDC bit is desirable because excess vibration of the drill bit reduces the effectiveness and ROP of the drill bit, and consequently increases costs.

A known drill bit is shown in FIG. 1. Bit 10 is a fixed cutter bit, sometimes referred to as a drag bit or PDC bit, and is adapted for drilling through formations of rock to form a borehole. Bit 10 generally includes a bit body having shank 13, and threaded connection or pin 16 for connecting bit 10 to a drill string (not shown) which is employed to rotate the bit for drilling the borehole. Bit 10 further includes a central axis 11 and a cutting structure on the face 14 of the drill bit, preferably including various PDC cutter elements 40. Also shown in FIG. 1 is a gage pad 12, the outer surface of which is at the diameter of the bit and establishes the bit's size. Thus, a 12" bit will have the gage pad at approximately 6" from the center of the bit.

As best shown in FIG. 2, the drill bit body 10 includes a face region 14 and a gage pad region 12 for the drill bit. The face region 14 includes a plurality of cutting elements 40 from a plurality of blades, shown overlapping in rotated profile. The action of cutters 40 drills the borehole while the drill bit body 10 rotates. Downwardly extending flow passages 21 have nozzles or ports 22 disposed at their lowermost ends. Bit 10 includes six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Gage pads 12 abut against the sidewall of the borehole during drilling. The gage pads can help maintain the size of the borehole by a rubbing action when cutters on the face of the drill bit wear slightly under gage. The gage pads 12 also help stabilize the PDC drill bit against vibration. However, one problem with conventional gage pad design is excessive wear to the gage pads 12 due to their rubbing action against the borehole wall. In hard and/or abrasive formations, and also in directional applications, a method known to have helped minimize the severity of this wear problem is the placement of wear resistant materials such as diamond enhanced inserts ("DEI") and TSP elements in the gage pad, as shown in FIG. 3.

FIG. 3 includes a drill bit body 10 having a face region 14 and a gage pad region 12 for the drill bit. Each gage pad region 12 includes a first DEI 300 located directly above a second DEI 310. DEI's resist wearing away by the rubbing action of the borehole wall because they are made of a harder and more wear resistant material than that used to construct the bit body and the gage pad. Consequently, the gage pads with DEI's and TSP's continue to maintain the bit's diameter for a longer period and enhance the bit's stabilization against vibration. However, in some applications such as in horizontal drilling or directional drilling, side cutting of the borehole wall is desirable. While this gage pad design stabilizes the drill bit, it does not cut the side borehole wall.

Side cutting is a drill bit's ability to cut the sidewall of the borehole, as contrasted to the bottom of the borehole. Good side cutting action minimizes torque generation by the gage pads and solves the problem of torque fluctuation or vibrational problems associated with current design technologies. As is appreciated by those of ordinary skill in the art, this is particularly important in directional drilling applications where a drill bit must achieve different trajectories as dictated by the wellbore's inclination or azimuth, instead of drilling straight ahead. Depending on the drilling program and the types of tools being used, a bit's efficiency in its application depends on its side cutting ability.

Attempts to increase the side cutting ability of a drill bit include designing a drill bit that cuts the borehole wall at the gage pad, rather than simply resisting wear with the gage pad. FIG. 4A illustrates a head-on view of a pair of identical gage pads 12. The rotated profile of these gage pads 12 thus appears the same as the head-on view of a single gage pad 12. Each gage pad 12 includes a plurality of cutting elements 440. Between and beyond the gage pad cutting elements 440 of each gage pad is bit body material that creates a gage pad surface 410 that extends to gage diameter 420. FIG. 4B illustrates a side view of FIG. 4A showing how the cutting elements 440 are arranged on a single gage pad.

As can be appreciated, a plurality of cutters extending to gage diameter presents a cutting surface to the wall of the borehole. Such cutters are active cutting elements in the sense that they actively cut, and do not simply rub, the sidewall of the borehole. Depending on the drilling program and the types of directional work needed, cutters 440 could be put under more challenging conditions than the cutters 14 on the bit's face. In the event of a breakage or loss of one or more of these cutting elements, little gage pad protection exists. Thus, the areas between the cutting tips of each of the cutters is filled with a hard material. This hard material forms a surface 410 at the bit diameter that attempts to maintain the bit's diameter. In the resulting design, if a gage pad cutting element breaks or becomes lost, the surface 410 of the gage pad resists wear and generally acts as a conventional gage pad. However, this design is not "aggressive" and fails to cut the borehole sidewall adequately when a significant change in the direction of the wellpath is required by the drilling program. Because side cutting is particularly important in directional drilling and rotary steerable applications, the inability to turn quickly is particularly problematic and undesirable. Further, in demanding applications such as in medium-hard, hard, or abrasive formations the material between the cutters wears away quickly and provides inadequate gage protection.

Some increased aggressiveness of the gage cutting elements could be obtained by an increased number of similarly sized gage cutting elements along a longer gage pad. However, a longer gage pad results in a slower turning drill bit. Thus this approach is not an ideal solution to the slow turn rate problem. Further, and very significantly, a longer gage pad with more cutters tends to induce higher vibration of the drill bit during drilling because those designs increase the loading, force, and torque which, in combination with the side pushing action needed to initiate and/or maintain the wellbore's path, would cause vibrations that become detrimental to operational efficiency. Drill bit designers have attempted to correct bit vibrational problems by altering the cutter layout on the face of the drill bit and by establishing effective force balancing methods. However, such stabilization methods are not always effective in the highly specialized drilling applications appropriate for a drill bit built with the inventive features disclosed herein.

Therefore, a drill bit is needed that gives effective gage protection and enhances stabilization and borehole integrity from the gage pads. The drill bit should resist bit vibration, aggressively cut the borehole wall, and turn direction quickly as needed in for directional drilling programs. This drill bit should also be resistant to cutter loss or breakage, and should be suitable for use with a variety of cutter layouts on the face of the drill bit.

SUMMARY OF THE INVENTION

An inventive feature of the invention includes a drill bit having first and second gage pads. The cutting elements on the first and second gage pads create in rotated profile a single set of contiguous, overlapping cutting elements. A variation on this is the inclusion of a third gage pad to create the cutting profile where the cutting elements on any two of the first, second and third gage pads do not create in rotated profile a single set of contiguous, overlapping cutting elements. The invention may also include a sloped or unsloped mounting surface to which the first plurality of cutting elements is attached, at least a portion of the mounting surface being disposed away from the bit body diameter. The gage pads may also include a flat portion at the diameter of the drill bit Viewed differently, an inventive feature is a drill bit having a body and a first, second, and third gage pad regions on the drill bit body. Each of these are preferably a gage pad. The first and second gage pad regions are "active" in that they include cutting elements along their length. In rotated profile these two active gage pad regions (perhaps in combination with other active gage pad regions) form a cutting profile suitable to cut a borehole sidewall. The third gage pad region is not active, and includes a flat, wear-resistant surface. It may also include increased wear-resistant inserts, such as DSP's.

Thus, the invention includes a combination of features and advantages that enable it to overcome various problems of prior drill bits and gage pads. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 5:
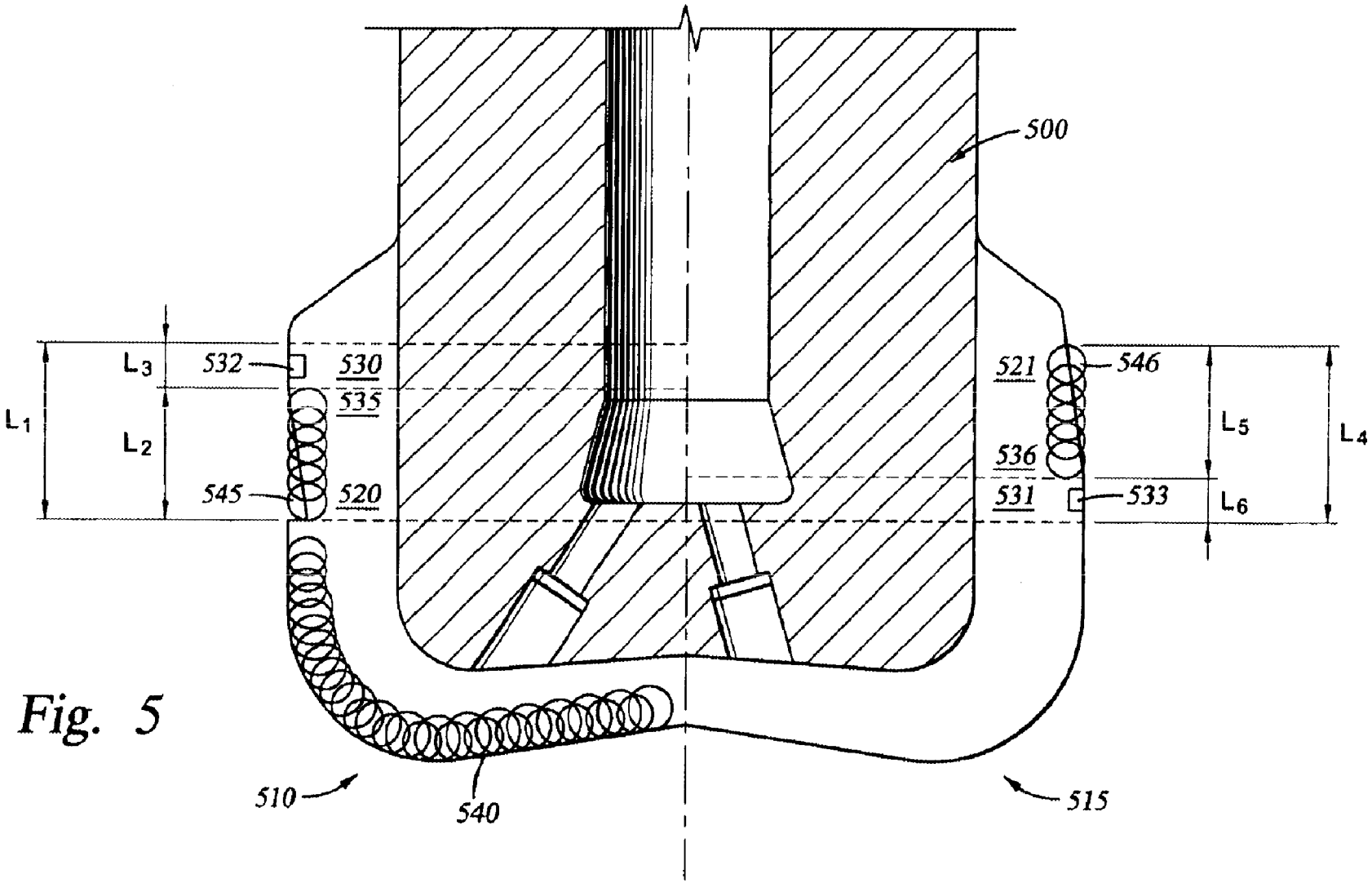
FIG. 5 is a cut away view in rotated profile of a drill bit according to a preferred embodiment of the invention.

A drill bit embodying features of the invention is shown in FIG. 5. Two cutting profiles corresponding to at least four gage pads of a drill bit are shown. In the preferred embodiment, the drag drill bit includes six gage pads, although as few as two gage pads could also be used.

A drill bit 500 includes first and second rotated profiles 510, 515 according to the preferred embodiment. First rotated cutting profile 510 includes a gage pad 520 of length $L_1$. This gage pad includes flat gage pad portion 530 of length $L_3$ substantially at gage diameter, and an angled gage pad portion 535 of length $L_2$. Flat gage pad portion 530 includes one or more wear resistant inserts 532. A plurality of polycrystalline diamond cutters 545 are embedded in the angled portion 535, and overlapping profiles of cutting elements 545 are shown. The cutting tips of cutters 545 extend substantially to the diameter of the drill bit. Also shown are cutter elements 540 along the face of the drill bit. Thus, at least two blades are necessary to create the illustrated overlapping profiles in first rotated cutting profile 510.

The second cutting profile 515 of FIG. 5 includes a gage pad 521 of length $L_4$. This gage pad includes flat gage pad portion 531 of length $L_6$ substantially at gage diameter, and an angled gage pad portion 536 of length $L_5$. Flat gage pad portion 531 includes one or more wear resistant inserts 533. A plurality of polycrystalline diamond cutters 546 are embedded in the angled portion 536. The cutting tips of cutters 546 extend to substantially gage diameter. In the preferred embodiment, the total length of the second gage pad 521 is $L_4$, and is approximately the same as the first gage pad length $L_1$. Similarly, lengths $L_6$ and $L_3$ are about the same, and lengths $L_5$ and $L_2$ are about the same. It should be understood that the flat gage pad portions are flat only with respect to the cross-sectional view of FIG. 5. Along the periphery of the bit, the gage pads curve with the body of the drill bit. The one or more wear resistant inserts may be (but are not limited to) a circular PDC insert about 6–22 mm in diameter, or may constitute multiple thermally stable polycrystalline inserts of about 3 mm×5 mm each.

A significant difference between the first gage pad 520 and the second gage pad 521 is the relative location of the flat portions 530 and 531 with respect to the angled portions 535 and 536. In the first cutting profile 510, the angled portion 535 lies near the face of the drill bit, with the flat portion 530 being located uphole closer to the bit shank. In the second cutting profile 515, the flat portion 536 lies near to the face of the drill bit with the angled portion 536 uphole closer to the bit shank. As shown, $L_5 \geqq L_3$ so that upon rotation of the entire drill bit 500, every region along the gage pad length $L_1$, $L_4$ is touched by at least one gage pad cutter 545, 546.

During side tracking, directional, and horizontal applications, it is the cooperative operation of both these cutting profiles that results in a side cutting of the full length of the gage pad. Because no single gage pad includes a set of cutters that cuts the entire length of the gage pad $L_1$, $L_4$, the torque on each gage pad is lower than it would be otherwise. This results in the elimination or drastic minimization of the vibrational levels that can be induced during side cutting.

Figure 6A:
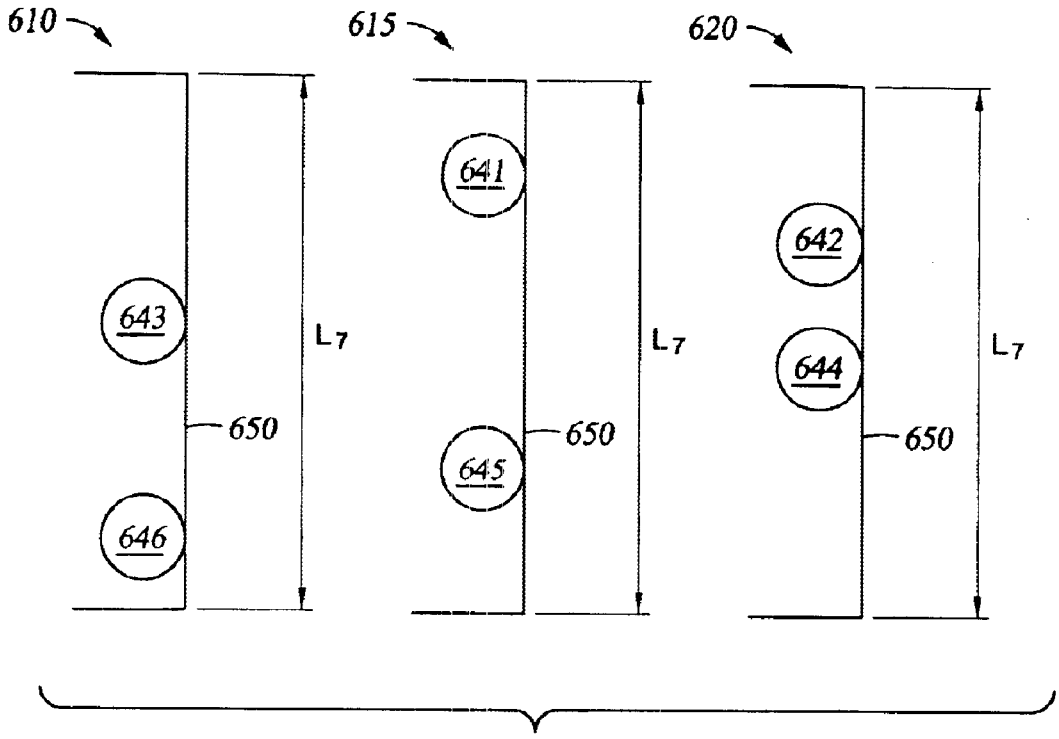
FIG. 6A is a straight ahead view of a set of gage pads.
Figure 6B:
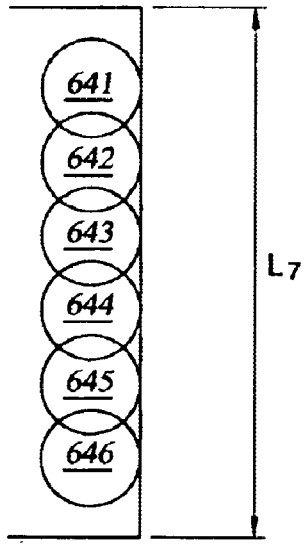
FIG. 6B is a view in rotated profile of the gage pads of FIG. 6A.

Arrangements such as that shown in FIGS. 6A and 6B would therefore also be within the scope of the invention. FIG. 6A includes the straight-ahead cutting profile from each of three gage pads on the same bit. Although these profiles are shown side-by-side, it should be understood that upon rotation of a drill bit including this gage pad cutter arrangement, the cutting elements on these two gage pads will result in the contiguous, overlapping cutting profile of FIG. 6B.

FIG. 6A includes a first gage pad 610, second gage pad 615, and third gage pad 620. Each gage pad 610, 615, 620 is approximately of length $L_7$. First gage pad 610 includes cutter elements 643 and 646 substantially extending to the diameter of the bit, also called the "gage diameter." Also shown on gage pad 610 is a line 650, which may define a flat surface of a material that is generally between cutter elements 643 and 646 and that extends to the diameter of the drill bit. This hard and abrasive resistant material would respond to the borehole sidewall as a wear-resistant gage pad. In the absence of such a material between cutter elements 643 and 646 extending to the diameter of the drill bit, line 650 may simply define the diameter of the drill bit, with the surface upon which elements 643, 646 are secured being elsewhere. Second gage pad 615 includes cutter elements 641 and 645 extending to about the diameter of the drill bit. Line 650 is also shown with relation to second gage pad 615. Third gage pad 620 includes cutter elements 642 and 644, as well as line 650.

As can be seen, none of gage pads 610, 615, 620 has a sufficient number of cutter elements to cover the full length $L_7$ of the gage pad. In fact, each of the illustrated gage pads includes cutter elements that occupy less than about 60%, and preferably less than about 50%, of the gage pad length. Regardless, when the cutting elements from each gage pad are placed together in rotated profile the cooperative operation of these three gage pads results in a full length cutting structure such as shown in FIG. 6B (although there may still be some small portion of the gage pad that, in rotated profile, is not covered by the cutting structure). Thus, the full length cutter structure might range from 80 to 100 percent of the gage pad length with the illustrated full length cutter structure occupying about 95% of the gage pad length. Such a configuration is particularly advantageous because by placing fewer cutting elements on each gage pad, the torque on each gage pad is lowered. Lower torque on each gage pad minimizes the amount of torque excitation or vibration on the drill bit.

Figure 7A:
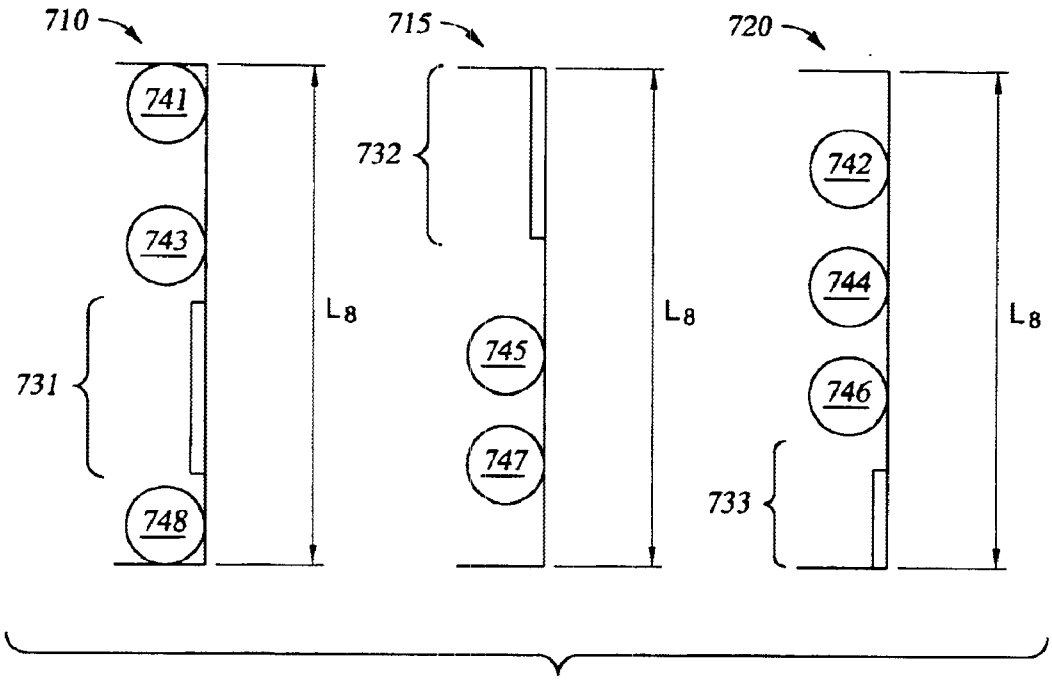
FIG. 7A is a straight ahead view of a set of gage pads.
Figure 7B:
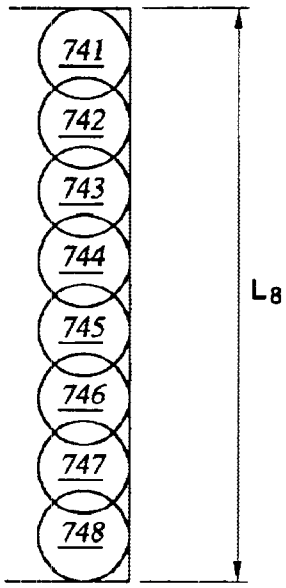
FIG. 7B is a view in rotated profile of the gage pads of FIG. 7A.

FIGS. 7A and 7B illustrate yet another cooperative gage pad cutter element design within the scope of the invention. Similar to the embodiment of FIGS. 6A and 6B, when the cutter elements from these three gage pads are placed together in rotated profile, a full length contiguous cutting structure results as shown in FIG. 7B.

Referring now to both FIGS. 7A and 7B, a first gage pad 710, second gage pad 715, and third gage pad 720 are each of length $L_8$. First gage pad 710 has cutter elements 741, 743, 748 extending to substantially gage diameter. First gage pad 710 also includes an area 731, all or a portion of which may contain a particularly wear and abrasive resistant material such as DEI or TSP inserts. Second gage pad 715 includes cutter elements 745, 747 extending to substantially gage diameter. Area 732 on second gage pad 715 may also contain a particularly wear and abrasive resistant material. Third gage pad 720 includes cutter elements 742, 744, 746, as well as area 733. As can be appreciated, the cutters from these three gage pads, in rotated profile, create a cutting profile of length $L_8$. Further, in rotated profile, areas 731, 732, and 733 coincide to cover a substantial length of the gage pads, and preferably coincide to cover the entire length $L_8$ of the gage pads. Thus, not only is each portion of the borehole sidewall corresponding to length $L_8$ being presented with an active cutting region, but a considerable portion of that length is also being presented with a wear-resistant region that helps to maintain gage and borehole integrity. The longer the bit maintains gage, the longer the useful life of the bit. Further, a true diameter borehole reduces operational and production costs because of the reduction of borehole drag and eases casing of the borehole. Each wear-resistant region according to this design may be enhanced by the addition of abrasion resistant inserts to extend drill bit life.

It should be noted that although each of the illustrated rotated cutting profiles extends the full length of the gage pad, a shorter cutting profile less than the full gage pad (whose length is defined by the terminal or end cutter elements in the rotated profile) yields many of the benefits of the inventive features shown in FIGS. 6 and 7, as long as the design uses the cooperative action of cutting elements from two or more gage pads, preferably three.

Figure 8:
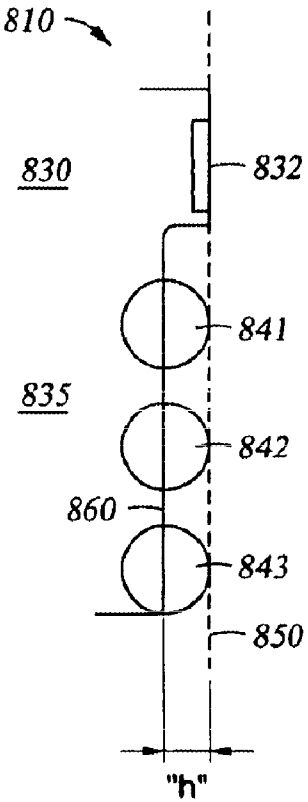
FIG. 8 is a straight ahead view of a gage pad with exposed cutter elements.

FIG. 8 includes a gage pad 810 having a flat wear-resistant region 830 and an active cutting region 835. Flat wear-resistant region 830 may optionally include an especially wear and abrasion resistant material 832, such as one or more DEI's or TSP's. Cutting region 835 includes a plurality of cutting elements 841, 842, 843 whose cutting tips extend to the diameter 850 of the drill bit. Cutting elements 841, 842, 843 are secured to and extend a height "h" above a mounting surface 860. Exposing the cutting elements 841, 842, 843 on the gage pad makes the cutting structure of the gage pad more aggressive. This increased aggressiveness makes these gage pads more capable of quickly cutting the borehole sidewall. Further, the increased aggressiveness of the cutting elements may allow shortening of the gage pad itself, which makes the drill bit capable of an even higher turn rate. High turn rates are extremely beneficial in high dog-leg applications. At the same time, the flat wear-resistant region 830 on the gage pads provides the drill bit gage protection and stabilization benefits associated with conventional non side-cutting gage pads.

Figure 1:
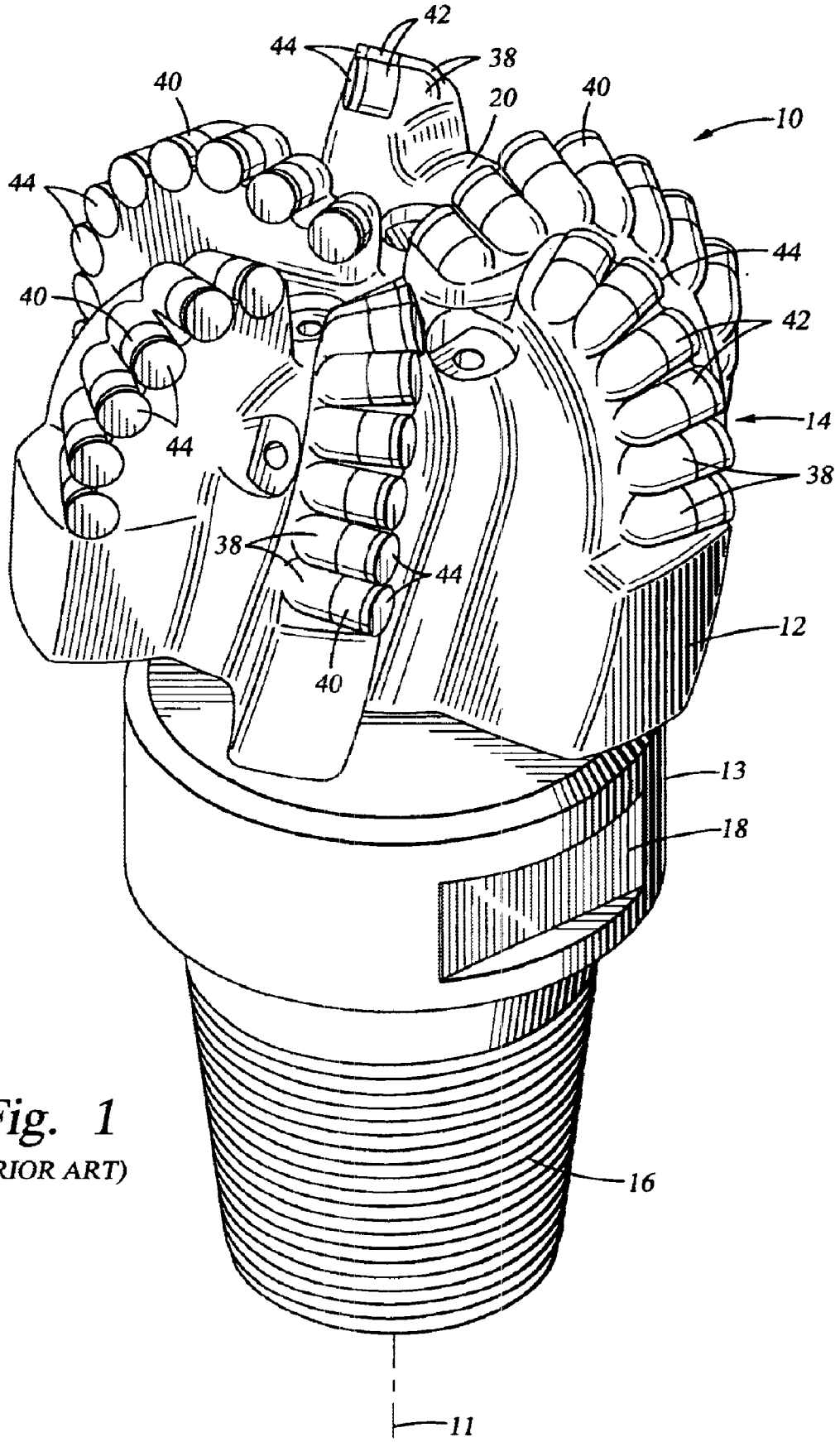
Fig. 1 (PRIOR ART)
FIG. 1 is a perspective view of a prior art drill bit.
Figure 2:
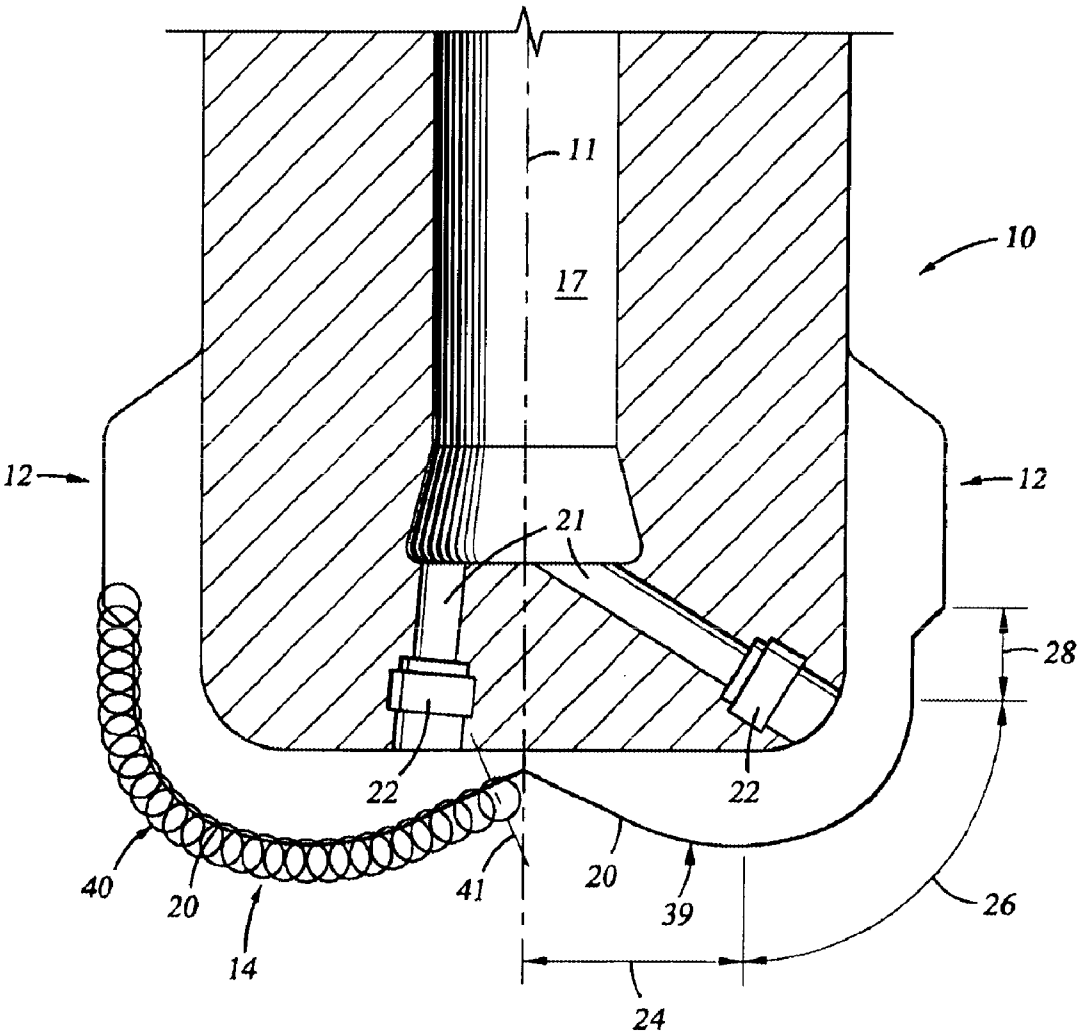
Fig. 2 (PRIOR ART)
FIG. 2 is a cut away view in rotated profile of a prior art drill bit.
Figure 3:
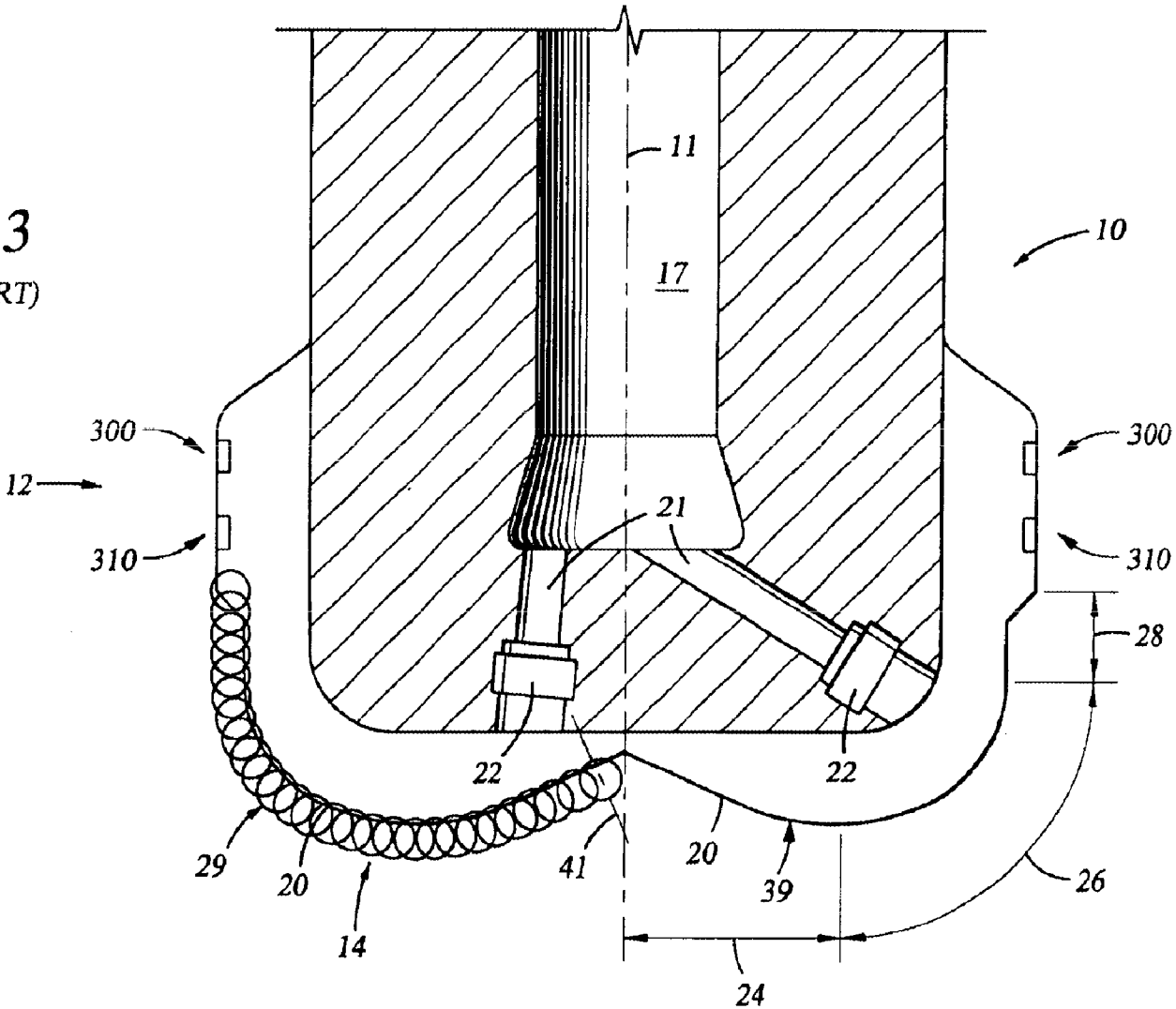
Fig. 3 (PRIOR ART)
FIG. 3 is a cut away view in rotated profile of a prior art drill bit having wear-resistant inserts.
Figure 4A:
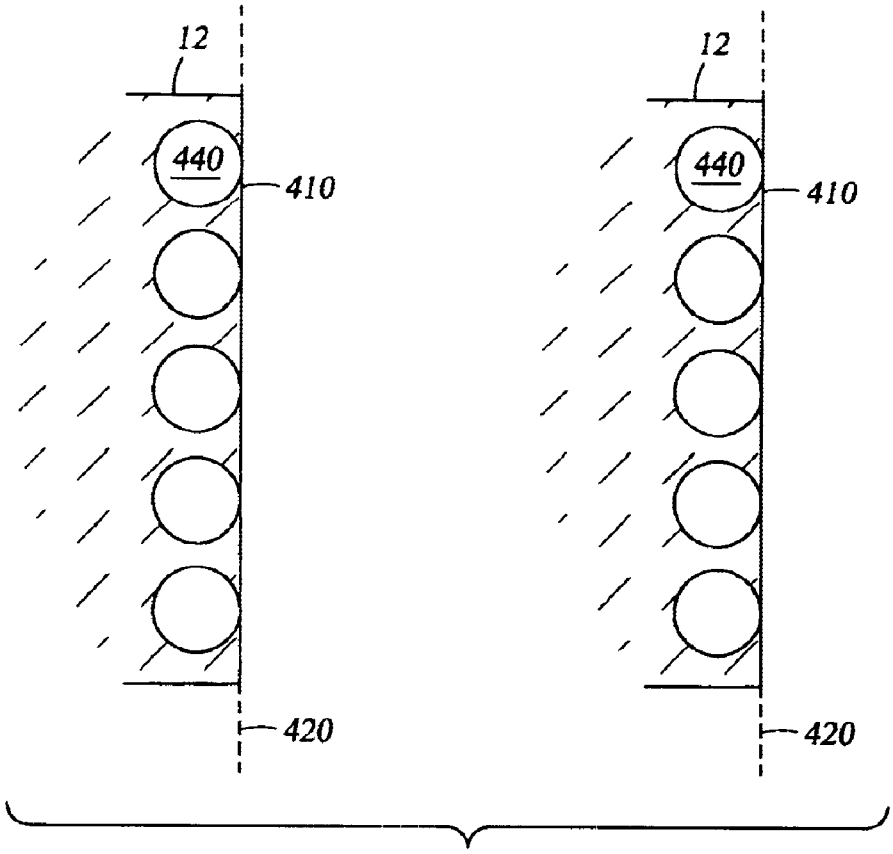
Fig. 4A (PRIOR ART)
FIG. 4A is a straight ahead view of a gage pad.
Figure 4B:
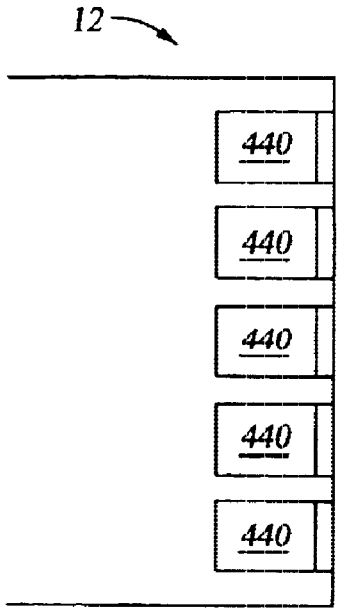
Fig. 4B (PRIOR ART)
FIG. 4B is a side view showing the arrangement of FIG. 4A.

The combination of the wear-resistant insert and the gage cutters on the same gage pad improves the performance of the drill bit. More specifically, by placing a wear resistant insert at one height of the gage insert, and gage pad cutters at a different height on the gage pad, an arrangement results that can yield the advantages of wear-resistant inserts with the side-cutting advantages of gage pad cutters. To fully exploit this advantage, the location of the wear resistant inserts can be at different positions along the length of the gage pad, such as shown for example in FIG. 5. This effectively results in gage pad protection as shown in FIG. 3 while offering improved side-cutting ability.

Figure 9:
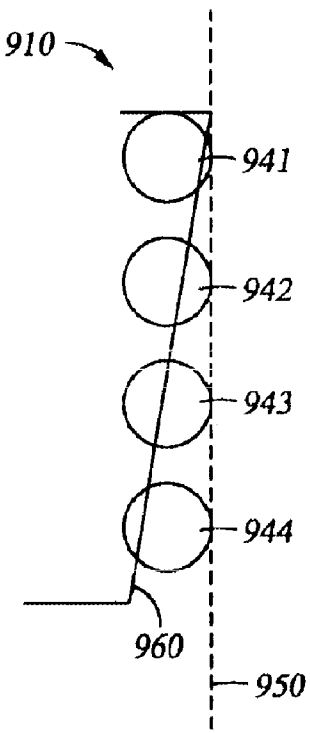
FIG. 9 is a straight ahead view of a gage pad with cutting elements having varied exposure heights.

Referring now to FIG. 9, another inventive feature angles a portion of the gage pad to expose the gage pad cutters at different heights to the surface upon which the cutters are mounted. A gage pad 910 includes a plurality of cutting elements 941–944 extending to the bit diameter 950. The gage pad 910 also includes a surface 960 that slopes away from bit diameter 950 while providing a surface upon which cutting elements 941–944 may be mounted. Similar to FIG. 8, the height of each cutter is measured with respect to the surface on which the cutter is attached. This angle of surface 960 consequently means that the cutting elements 941–944 have progressively greater exposure heights, and hence become progressively more aggressive, along the length of the gage pad.

This variation in cutter exposure "height" can be helpful when drilling through formations of varying hardnesses or it may serve as an adjustable design feature for varying rates of directional changes in inclination, azimuth, or both. To ensure aggressive profiles along the entire length of the gage pad, the more exposed gage pad cutters may be at different locations along the length of different gage pads, as shown for example in FIG. 5.

Figure 11:
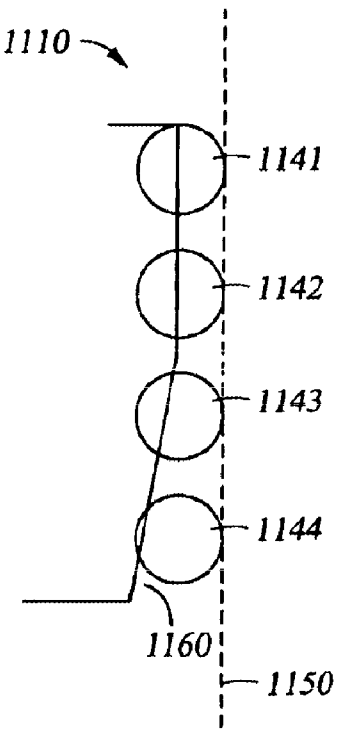
FIG. 11 is a straight ahead view of a gage pad with a portion of cutting elements having the same exposure height and a portion of cutting elements having varied exposure heights.

The particular angle selected for surface 960 is dependent on the bit size, the length of the angled portion, and the drilling program. A seven degree angle away from gage diameter 950 for surface 960 might be appropriate, but a more severe angle for surface 960 may be preferable for high dog-leg applications. In fact, the angle may even change over the length of the surface 960 if a curved surface is used instead of a straight surface. As another variation, the angled portion may instead be a cut-out trough portion or a valley "V" portion that supports the cutting elements 941-944. Further, the variation in exposure height need not extend over the entire gage pad; two or more cutting elements on the same gage pad may be of the same exposure height, such as shown in for example FIG. 11.

Figure 10:
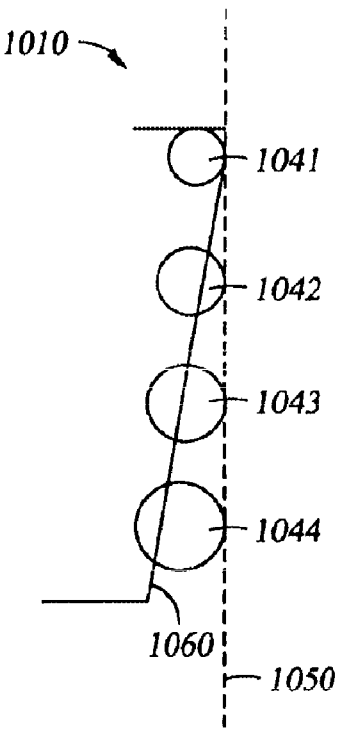
FIG. 10 is a straight ahead view of a gage pad with variable-sized cutting elements having differing exposure heights.

FIG. 10 shows one possible embodiment where the gage pad cutters vary in size. A gage pad 1010 that includes a plurality of cutting elements 1041–1044 extending to gage diameter 1050. The gage pad 1010 also includes a surface 1060 that slopes away from gage diameter 1050 while providing a surface upon which cutting elements 1041–1044 may be mounted. Unlike the same-size cutting elements shown in FIG. 9, cutting elements 1041–1044 are not all of the same diameter. The cutters may alternate in diameter, become progressively larger or smaller, or have some other pattern that varies the gage cutting element diameter.

Similar benefits may be achieved by proper placement of cutting and non-cutting gage pads around the circumference of the drill bit. For example, the proper use of active gage pads and non-active gage pads on a drill bit is expected to yield the same sidewall cutting and borehole integrity advantages as described above. In either case, a composite (i.e. combination) profile results upon full rotation of the drill bit. This composite profile has a cutting portion and a non-cutting portion. The cutting portion of the profile includes cutting elements mounted on a surface that does not extend to gage diameter (although the cutting tips of the cutting elements extend to approximately gage diameter). It is to be understood that these cutting elements are in reality mounted on two or more surfaces that, if at the same diameter, would appear as a single surface in rotated profile. The non-cutting portion has a flat, wear-resistant surface that extends to gage diameter. In addition, the cutting portion and non-cutting portion also overlap along at least a portion of their lengths so that a particular point at the borehole sidewall could make contact with both active and non-active portions of gage pads on the side of a drill bit (assuming the drill bit rotates but does not move vertically).

Figure 12:
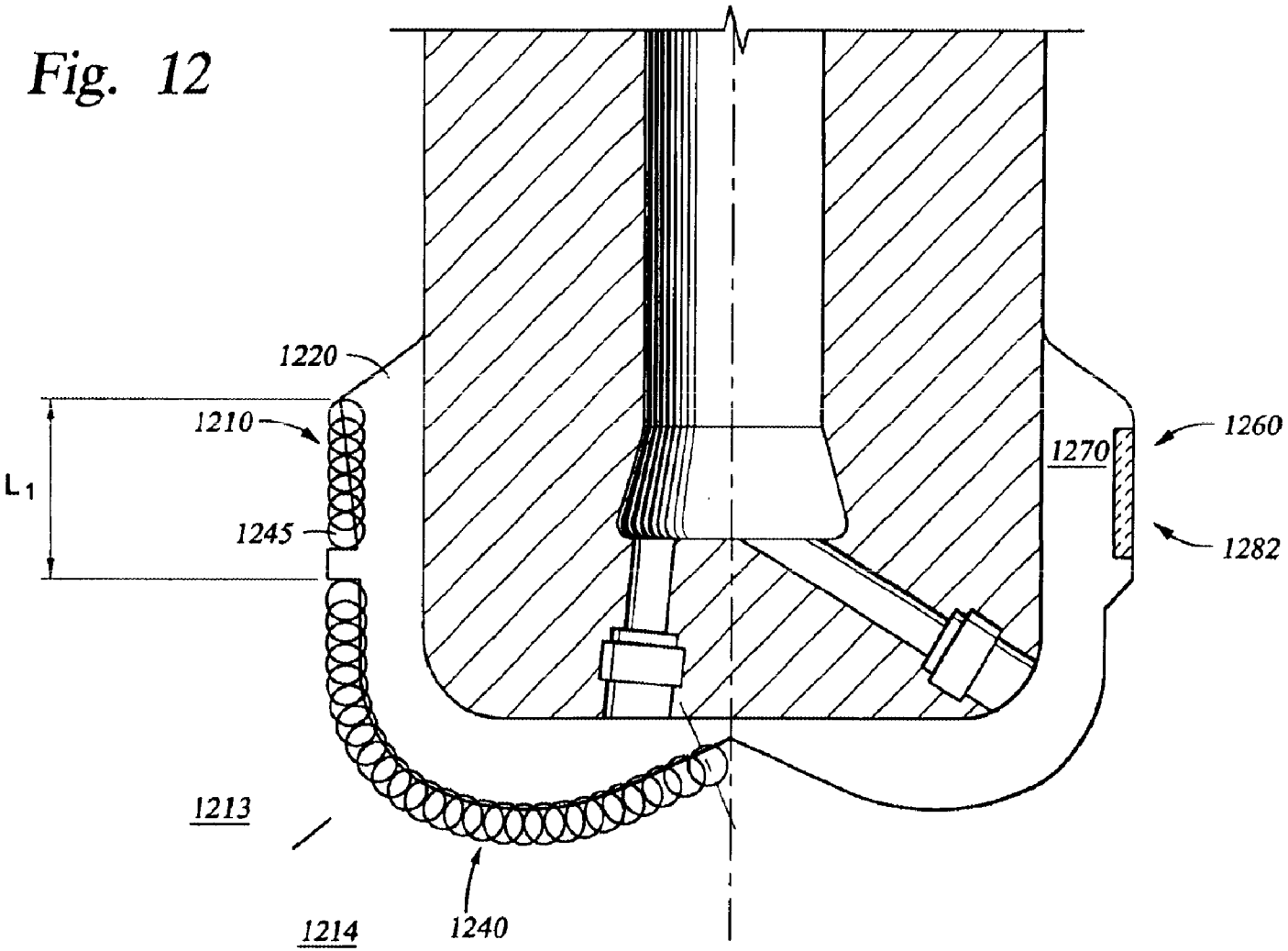
FIG. 12 is a cut away view in rotated profile of a drill bit according to a preferred embodiment of the invention.

FIG. 12 shows a drill bit body 1210 having a face region 1214, a shoulder region 1213, and a gage pad region 1212 on the drill bit. It is to be understood that the demarcation between face and shoulder regions is not a definite one but instead is a gradual transition. Also shown are cutting elements 1240 along the face of the drill bit.

First rotated active (i.e. cutting) profile 1210 corresponds to a gage pad area 1220 of length $L_1$. A plurality of polycrystalline diamond cutters 1245 are embedded in gage pad area 1220, and overlapping profiles of cutting elements 1245 are shown. FIG. 12 shows a contiguous, overlapping cutting profile for the cutting elements of the sidewall gage pads in rotated profile. The cutting tips of cutting elements 1245 extend substantially to the diameter of the drill bit (i.e. gage diameter). These types of gage pads achieve cutting of the borehole sidewall. Overly aggressive cutting of the borehole sidewall can result in a difficult to steer drill bit that tends toward high torque and vibration, however. At least two active gage pads or the like are necessary to create the illustrated overlapping profiles in first rotated cutting profile 1210.

Second rotated non-active (i.e. not cutting) profile corresponds to a second gage pad area 1270 of length $L_2$. This profile includes a flat gage pad portion substantially at gage diameter. Each non-active gage pad 1212 includes one or more wear resistant inserts 1282. These wear resistant inserts may be one or more DEI's 300. DEI's and TSP's resist wearing away by the rubbing action of the borehole wall because they are made of a harder and more wear resistant material than that used to construct the bit body and the gage pad. Consequently, the gage pads with DEI's and TSP's continue to maintain the bit's diameter for a longer period and enhance the bit's stabilization against vibration. However, in some applications such as in horizontal drilling or directional drilling, side cutting of the borehole wall is desirable. While this gage pad design stabilizes the drill bit, it does not cut the side borehole wall. At least one blade is necessary to create the illustrated profile of FIG. 12.

Figure 13A:
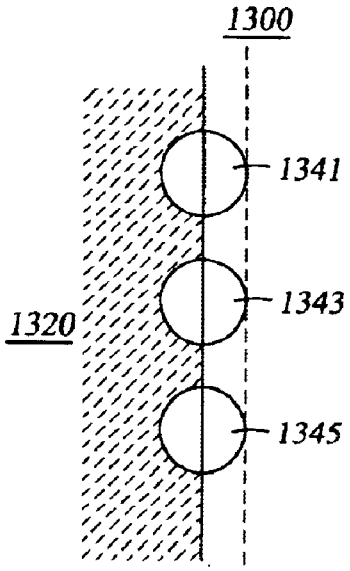
FIGS. 13A–13C are a straight ahead views of a set of active gage pads and those gage pads in rotated profile.
Figure 13B:
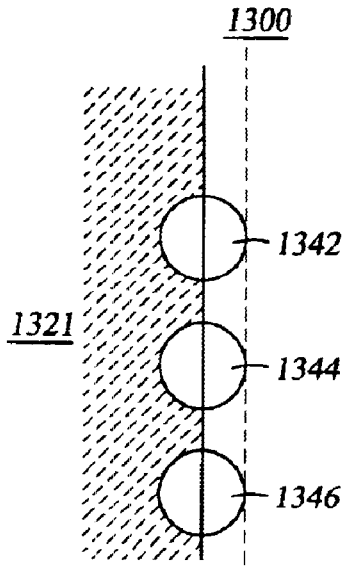
Figure 13C:
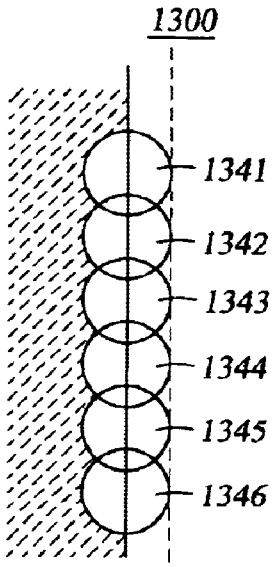

FIGS. 13A–13C show front views of two complementary active gage pads suitable for use in the drill bit of FIG. 12. Gage pads 1320 and 1321 include cutting elements 1341–1346. In particular gage pad 1320 includes cutting elements 1341, 1343, and 1345. Gage pad 1321 includes cutting elements 1342, 1344, and 1346. The cutting tips of each cutting elements 1341–1346 extends to gage line 1300. FIG. 13C shows the gage pads of FIGS. 13A and 13B in rotated profile. For maximum cutting effect, the rotated profile of cutting elements 1341–1346 preferably results in a continuous active cutting profile along the entire length of the gage pad.

Figure 14A:
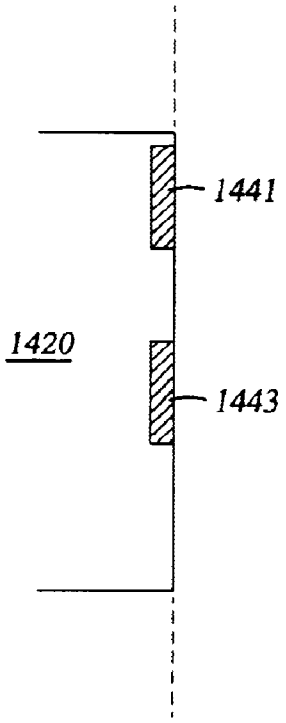
FIGS. 14A–14C are a straight ahead views of a set of non-active gage pads and those gage pads in rotated profile.
Figure 14B:
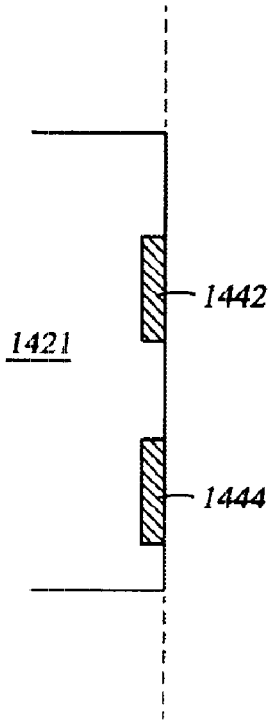
Figure 14C:
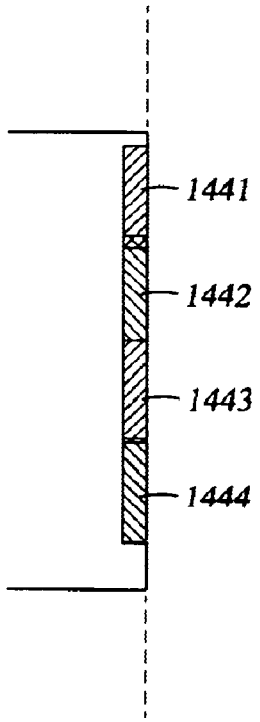

FIGS. 14A–14C show front views of two complementary non-active gage pads with wear-resistant inserts suitable for use in the drill bit of FIG. 12. Gage pads 1420 and 1421 include inserts 1441–1444. In particular, gage pad 1420 includes inserts 1441 and 1443 and gage pad 1421 includes inserts 1442 and 1444. Each of these gage pads, and their corresponding inserts, extend to gage diameter (also known as the nominal diameter) to maintain the size of the borehole. FIG. 14C shows the gage pads of FIGS. 14A and 14B in rotated profile. In this case, the wear-resistant inserts such as DSP's do not need to overlap one another (although that is an alternative). For increased wear resistance, however, the entire length of the gage pads around the drill bit should in rotated profile include wear-resistant inserts.

Figure 15:
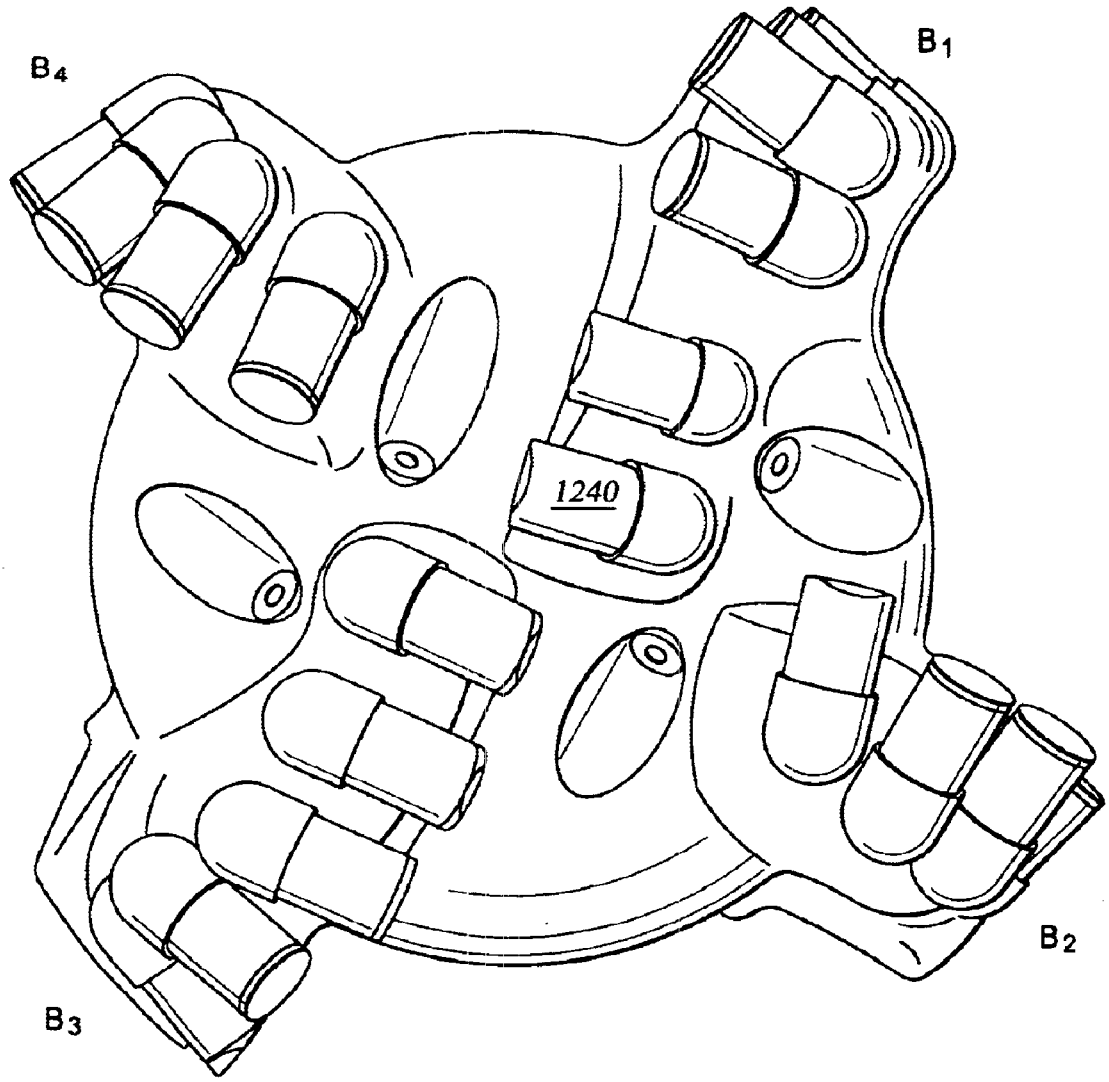
FIG. 15 is a top view of a four blade drill bit.

A suitable array of active and non-active gage pads may be placed in a variety of ways on a drill bit. For example, FIG. 15 illustrates a face view of a drill bit having four blades, $B_1$–$B_4$. As can be appreciated by one of ordinary skill in the art, these four blades correspond to four gage pads around the circumference of the drill bit. Blades $B_1$ and $B_3$ preferably would correspond to active, cutting gage pads, such as shown in FIGS. 13A–13C. Blades $B_2$ and $B_4$ would preferably correspond to the non-active, wear resistant gage pads such as shown in FIGS. 14A–14C. The alternation of active and non-active gage pads is not absolutely required but is preferred because of the realities of drill bit design. An imbalanced design (such as placement of active gage pads on blades $B_1$ and $B_2$ and placement of non-active gage pads on blades $B_3$ and $B_4$) creates mass imbalances because the mass center is offset from the symmetrical center of the drill bit. Such mass imbalance likely leads to eccentric rotation and lateral offset of the drill bit, shortening bit life. Unless some other drill bit modification is made, therefore, an imbalanced design is not preferred.

The degree of side cutting depends on at least three factors: 1) the number of cutting elements on the drill bit; 2) the magnitude of relief of the cutting elements (i.e. how exposed the cutting elements are); and 3) the angle between the gage pads. A smaller angle between the active gage pads therefore results in more severe sidewall cutting, all other factors remaining constant. Such a smaller angle between sidewall cutting elements can be accomplished by an increase in the number of blades on the face of the drill bit.

Figure 16:
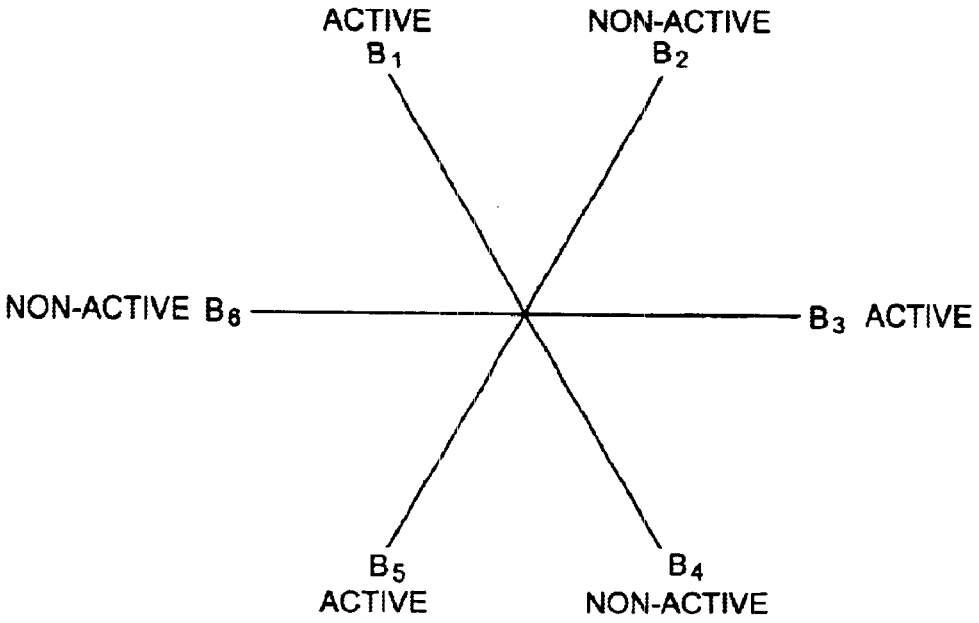
FIG. 16 is a schematic of a six-blade drill bit.

FIG. 16 shows a simple schematic of a six-blade drill bit having blades labeled $B_1$–$B_6$. Alternating blades $B_1$, $B_3$, and $B_5$ include active gage pads, whereas alternating blades $B_2$, $B_4$, and $B_6$ include non-active gage pads. In the case of a six-blade drill bit with three active gage pads, a designer may choose to have two of those three active gage pads create the rotated profile of, for example, FIG. 13C, with the cutting elements on the third gage pad being redundant to the set of cutting elements on one of the first two gage pads. Alternatively, the designer may choose to use all three gage pads to create a continuous cutting profile. Similar approaches may be used for the wear-resistant gage pads in FIG. 16.

Figure 17:
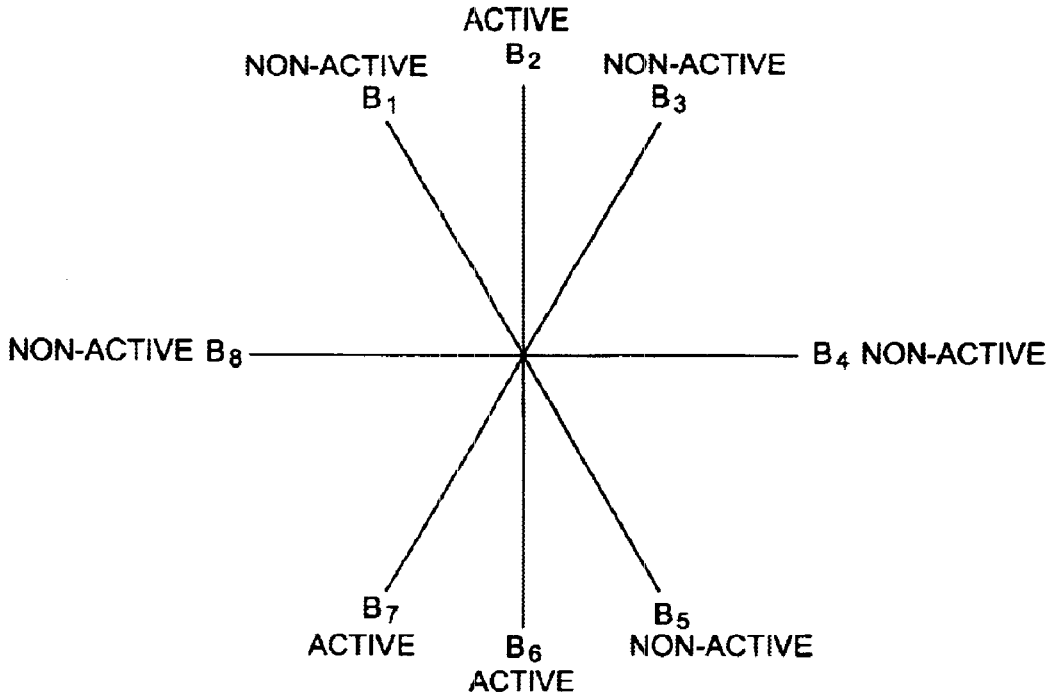
FIG. 17 is a schematic of a seven-blade drill bit.

FIG. 17 shows a simple schematic of a eight-blade drill bit having blades labeled B–$B_8$. Blades $B_2$, $B_3$, $B_6$, and $B_7$ correspond to active gage pads with cutting elements. Blades $B_1$, $B_4$, $B_5$, and $B_8$ correspond to non-active gage pads. As above, it is left to the designer to determine whether to use gage pads with cutting elements that are redundant to cutting elements on other active gage pads, or whether to design a drill bit having closely overlapping cutting elements. Similarly, it is left to the designer to decide how many and how large inserts should be on each non-active gage pad. But regardless, a drill bit results that has both a cutting feature and a wear-resistant feature at the same radial location on the drill bit.

Figure 18A:
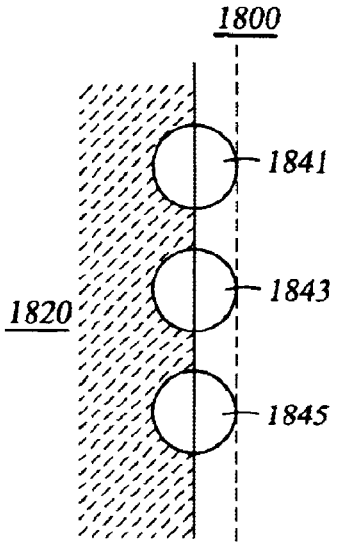
FIGS. 18A–C are straight ahead views of a set of active gage regions and those gage regions in rotated profile.
Figure 18B:
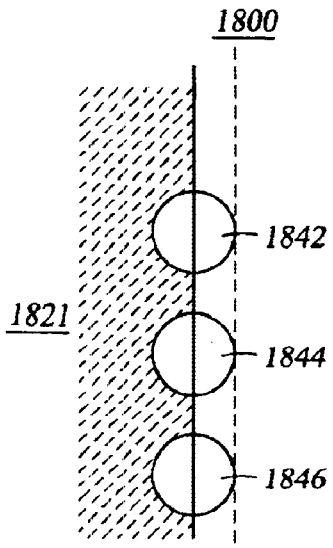
Figure 18C:
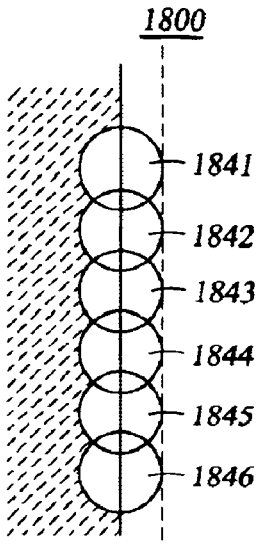
Figure 19A:
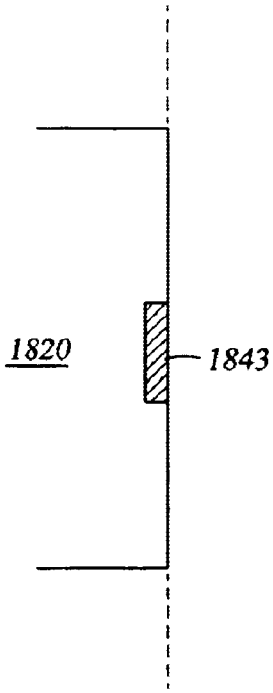
FIGS. 19A–19C are straight ahead views of a set of non-active gage regions and those gage regions in rotated profile.
Figure 19B:
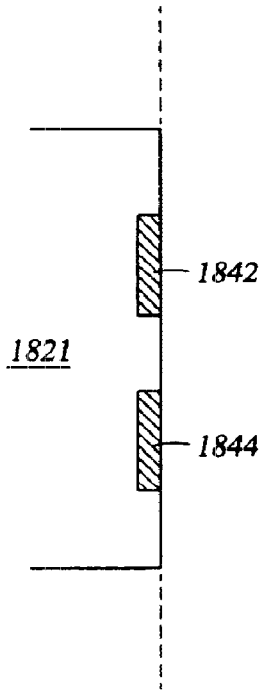
Figure 19C:
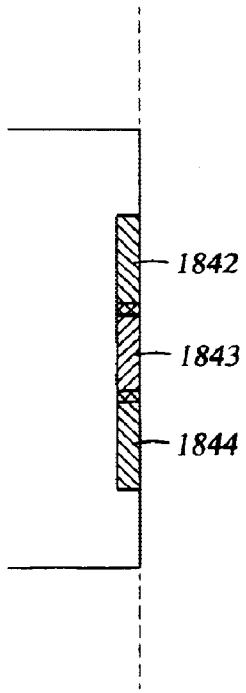

FIGS. 18A–18C and 19A–19C are similar to those shown in FIGS. 13A–13C and 19A–19C but the non-active gage regions of FIGS. 19A–19C are shorter than the active gage regions of FIGS. 18A–18C.

Other variations to these embodiments may be made and still be within the scope of the invention. For example, the gage pad need only be substantially at gage or approximately at gage. "Substantially at gage" or "approximately" gage is close enough to the diameter of the drill bit to accomplish the function of a gage pad, and is envisioned to include about 20 or even 50 thousandths of an inch below bit diameter. In addition, the wear resistant inserts may be any appropriate number, material, substance or design. For example, the described wear resistant inserts may be diamond enhanced inserts, thermally stable polycrystalline, carbide in hard steel, or any other suitable wear-resistant material. Different size and shape cutting elements may also be employed. Further, although gage pads are the natural location for the cutting and wear-resistant elements discussed above, the design could be modified to place active and non-active portions elsewhere.

While preferred embodiments of this invention have been shown and described, other modifications thereof can be made by one skilled in the art without departing from the spirit or teaching of this invention. The embodiments described herein are exemplary only and are not limiting. Many other variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A side-cutting drill bit, comprising:

a drill bit body having a face portion, a shoulder portion, and a side portion, said drill bit body defining a gage diameter;

at least first, second, and third gage regions on said side portion of said drill bit;

wherein all of said gage regions, in rotated profile, overlap to form a composite profile, said composite profile including a series of overlapping cutting elements mounted on surfaces not extending to substantially gage diameter and having cutting tips extending to substantially gage diameter, and said composite profile including a flat gage surface extending to substantially gage diameter, said overlapping cutting elements and said gage surface also overlapping over at least a portion of their respective lengths.

2. The side-cutting drill bit of claim 1, wherein said first gage region includes a first plurality of cutting elements to cut to gage diameter, said third gage pad region includes a second plurality of cutting elements to cut to gage diameter, and said second gage pad region includes a substantially flat portion extending substantially to gage diameter.

3. The side-cutting drill bit of claim 1, wherein said gage surface is co-extensive with said overlapping cutting elements.

4. The side-cutting drill bit of claim 1, wherein said gage surface has a first length and said overlapping cutting elements have a second length, said first length being longer than said second length.

5. The side-cutting drill bit of claim 1, wherein said gage surface has a first length and said overlapping cutting elements have a second length, said second length being longer than said first length.

6. The side-cutting drill bit of claim 1, wherein each of said first, second, and third gage regions are gage pads.

7. The side-cutting drill bit of claim 1, wherein said drill bit has at least a first blade, a second blade, and a third blade, said first gage region corresponding to said first blade, said second gage region corresponding to said second blade, and said third gage region corresponding to said third blade.

8. The side-cutting drill bit of claim 1, said drill bit including six blades, a fourth gage region, a fifth gage region, and a sixth gage region, three of said six gage regions including cutting elements and three of said six gage regions including wear-resistant inserts.

9. The side-cutting drill bit of claim 1, said drill bit including eight blades, a fourth gage region, a fifth gage region, a sixth gage region, a seventh gage region, and an eighth gage region, four of said eight gage regions including cutting elements and four of said eight gage regions including wear-resistant inserts.

10. The side-cutting drill bit of claim 1, wherein said gage surface is a non-cutting, flat surface along its entire length.

11. The drill bit of claim 1, wherein at least one of said surfaces is sloped.

12. The drill bit of claim 1, said drill bit body having a pin end and a drilling end wherein at least a first of said surfaces is sloped such that said cutting elements on said first surface are more aggressive proximate said pin end than said cutting end and wherein at least a second of said surfaces is sloped such that said cutting elements on said second surface are more aggressive proximate said cutting end than said pin end.

13. The drill bit of claim 1, wherein at least two of said surfaces is sloped.

14. A drill bit, comprising:

a drill bit body having a face portion, a shoulder portion, and a side portion, said drill bit body defining a gage diameter;

at least first, second, and third gage regions on said side portion of said drill bit;

wherein said first gage region includes a first set of cutting elements having cutting tips extending to said gage diameter, said second gage region includes a second set of cutting elements having cutting tips extending to said gage diameter, and said third gage region being free from cutting elements and having a flat surface extending to gage diameter; and wherein said first set of cutting elements are mounted on a sloped surface such that at least a first element of said first set of cutting elements is more aggressive than at least a second cutting element of said first set of cutting elements.

15. The drill bit of claim 14, wherein said first and second set of cutting elements overlap to form a continuous cutting profile.

16. The drill bit of claim 14, further comprising fourth, fifth, and sixth gage regions, said fourth gage region including a third set of cutting elements having cutting tips extending to said gage diameter, said fifth gage region being free from cutting elements and having flat surface extending to gage diameter, and said sixth gage region being free from cutting elements and having flat surface extending to gage diameter.

17. The drill bit of claim 16, wherein said third, fifth, and sixth gage regions each maintain borehole diameter by rubbing formation at the sidewall of the borehole.

18. The drill bit of claim 16, wherein said third, fifth, and sixth gage regions each include wear-resistant inserts.

19. The drill bit of claim 16, wherein said first, second, and third set of cutting elements overlap to form a continuous cutting profile.

20. The drill bit of claim 14, wherein cutting elements on said side of said drill bit body overlap in rotated profile to form a continuous cutting profile.

21. The drill bit of claim 20, wherein said continuous cutting profile is as long as said first gage region.

22. The drill bit of claim 14, wherein said first gage region is a first gage pad, said second gage region is a second gage pad, and said third gage region is a third gage pad.

23. The drill bit of claim 14, further comprising fourth, fifth, sixth, seventh and eighth gage regions, said fourth gage region including a third set of cutting elements having cutting tips extending to said gage diameter, said fifth gage region being free from cutting elements and having flat surface extending to gage diameter, said sixth gage region being free from cutting elements and having a flat surface extending to gage diameter, said seventh gage region including a fourth set of cutting elements having cutting tips extending to said gage diameter, and said eighth gage region being free from cutting elements and having a flat surface extending to gage diameter.

24. The drill bit of claim 14, wherein said third gage region is a gage pad having wear-resistant inserts.

25. The drill bit of claim 14, wherein said first set of cutting elements are mounted on a sloped surface such that at least a first element of said first set of cutting elements is more aggressive than at least a second cutting element of said first set of cutting elements.

26. The drill bit of claim 14, wherein said first, second and third gage regions correspond to first, second and third blades on said drill bit of claim 14.

27. The drill bit of claim 14, wherein said third gage region is between said first gage region and said second gage region.

28. The drill bit of claim 14, said drill bit body having a pin end and a drilling end wherein said first gage region is sloped such that said first set of cutting elements is more aggressive proximate said pin end than said cutting end and wherein said second gage region is sloped such that said second set of cutting elements is more aggressive proximate said cutting end than said pin end.

* * * * *